United States Patent [19]

Simons et al.

[11] 4,105,076

[45] Aug. 8, 1978

[54] CONCEALED SPRINKLER HEAD

[75] Inventors: John R. Simons, Delavan; John W. Fenske, Wauwatosa, both of Wis.

[73] Assignee: Grunau Company Inc., Milwaukee, Wis.

[21] Appl. No.: 743,904

[22] Filed: Nov. 22, 1976

[51] Int. Cl.[2] ..... A62C 37/08

[52] U.S. Cl. ..... 169/40; 169/42

[58] Field of Search ..... 169/37–42

[56] References Cited

U.S. PATENT DOCUMENTS

| | | | |
|---|---|---|---|
| 302,991 | 8/1884 | Fowler | 169/40 |
| 2,591,872 | 4/1952 | Rider | 169/40 X |
| 3,388,747 | 6/1968 | Hopnett | 169/39 |
| 3,714,989 | 2/1973 | Gloeckler | 169/39 X |
| 3,998,273 | 12/1976 | Juliano | 169/37 |
| 4,014,388 | 3/1977 | Anderson | 169/37 |
| 4,015,665 | 4/1977 | Simons et al. | 169/40 |

*Primary Examiner*—John J. Love

*Attorney, Agent, or Firm*—Andrus, Sceales, Starke & Sawall

[57] ABSTRACT

An improved concealed sprinkler head for an automatic sprinkler system. The sprinkler head includes an orifice body that is mounted above the ceiling of the building and is connected to the water line. The body has an outlet which is normally closed by a valve cap, and the cap is held in the closed position by a lever assembly which includes a lever and a leaf spring. The lever has a pair of parallel spaced arms and a tube, which houses a fusible metallic element, extends between the arms. Balls are located within the ends of the tube on either side of the fusible element and impressed into the ends of the element, and the balls are engaged with sockets in the arms. One end of the lever is engaged with an abutment on the valve body and the opposite end of the lever is engaged with the leaf spring which is fulcrummed on the abutment. The leaf spring bears against the tube and urges the tube in a downward direction. A decorative plate is positioned against the ceiling and is connected by a fusible material to a cup-shaped plastic sleeve that is slidable on the body. When the decorative plate is exposed to an elevated temperature, the fusible material will melt enabling the decorative plate to be released, and subsequently the fusible element associated with the lever asembly will melt to release the lever assembly and open the valve cap.

25 Claims, 6 Drawing Figures

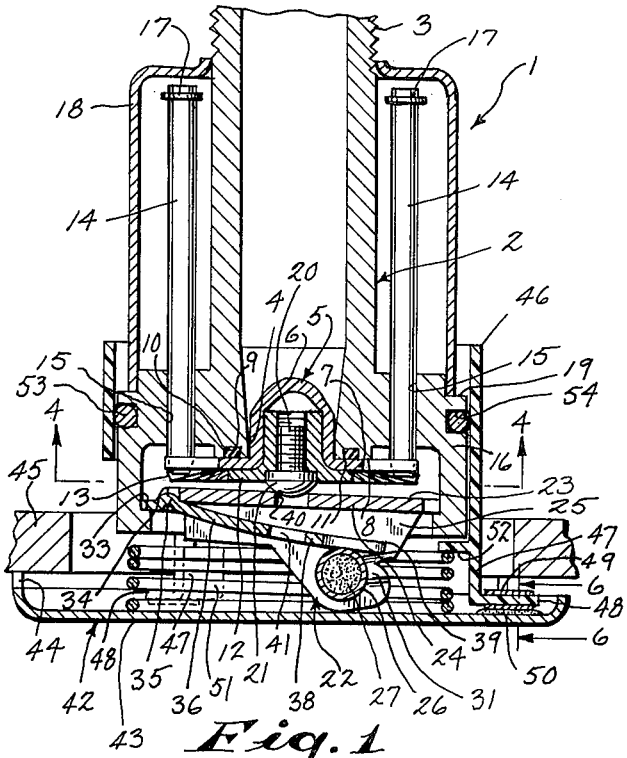
Fig. 1
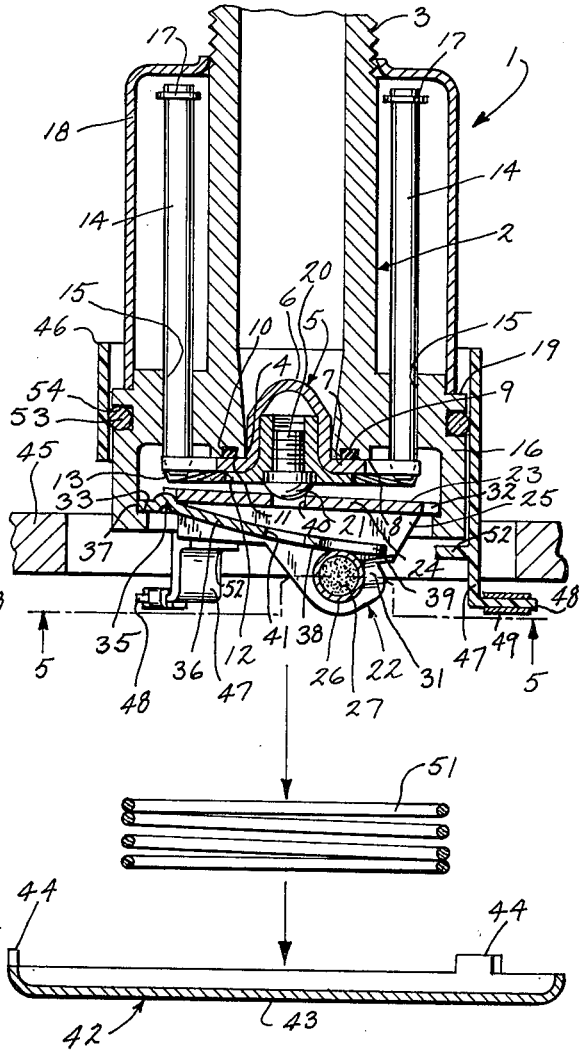
Fig. 2
Fig. 4
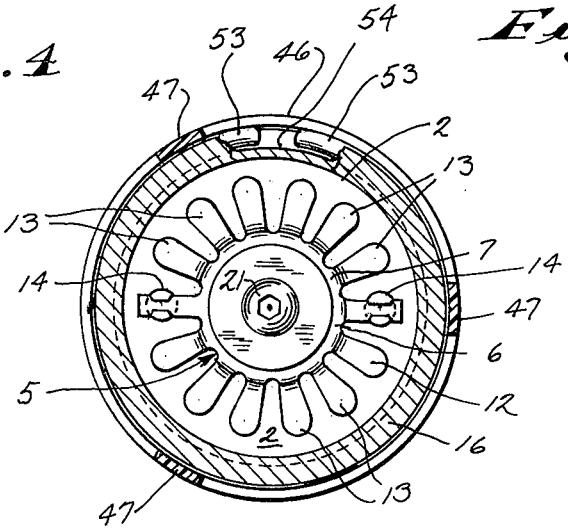

CONCEALED SPRINKLER HEAD

BACKGROUND OF THE INVENTION

The conventional automatic sprinkler head is connected to a water line and includes a body or frame that has an outlet orifice which is normally closed by a cap, and the cap is held in the closed position by a lever assembly which includes a low melting point fusible element. When the ambient temperature is increased to a predetermined level, the element will melt, releasing the lever assembly to open the orifice and discharge the water.

In residential dwellings and office buildings, it is often desired to utilize a sprinkler head that is located above the ceiling so that the operative parts are not exposed to view. In some cases, the sprinkler head is mounted within a recessed cup in the ceiling, and while the sprinkler head is recessed within the ceiling, the operative parts are not concealed.

In other instances, the sprinkler head is concealed within the ceiling by a decorative plate which is mounted flush against the ceiling so that none of the operative parts are visible.

In some concealed sprinkler head installations, such as disclosed in U.S. Pat Nos. 3,633,676, 3,714,989 and 3,756,321, the decorative plate is attached to the sprinkler head by a fusible material and when the sprinkler head is exposed to an elevated temperature, the fusible material will melt to release the decorative plate. Subsequently, the fusible element of the lever assembly will melt to release the lever assembly and open the valve cap. With sprinkler heads of this type, as used in the past, the fusible element associated with the lever assembly has been located a substantial distance above the lower surface of the ceiling and as a result the response rate of this type of sprinkler head has been relatively slow. In an attempt to increase the response rate, heat transfer fins or ribbons, such as disclosed in U.S. Pat. No. 3,756,321, have been associated with the lever assembly, and on release of the decorative plate, the fins drop down below the ceiling level in an attempt to increase the rate of heat transfer to the fusible element associated with the lever assembly.

In order to properly position the decorative plate of the concealed sprinkler head with respect to the ceiling, the valve body of the sprinkler head must be installed a precise distance from the lower surface of the ceiling. Concealed sprinkler heads, as used in the past, have had minimum provisions for adjustment, with the result that if the critical distance between the valve body and the ceiling was not maintained, the decorative plate of the sprinkler head could not be installed flush with the ceiling.

SUMMARY OF THE INVENTION

The invention is directed to an improved concealed automatic sprinkler head. The sprinkler head includes an orifice body which is located above the ceiling and is connected to the water line, while the lower end of the orifice body defines an outlet opening which is normally closed by a valve cap which is formed integrally with a deflector. According to the invention, the valve cap is held in the closed position by a lever assembly which includes a lever and a leaf spring. The lever is provided with a pair of spaced parallel arms or flanges, and a tube, which houses a fusible metallic element, extends between the arms. Located in each end of the tube, and impressed into the respective end of the fusible element, is a movable element or ball which is engaged with a socket in the respective arm of the lever.

A compression screw, which is threaded in the valve cap, bears against the central portion of the lever, and one end of the lever is engaged with an internal abutment formed on the valve body while the opposite end of the latch bar is engaged with a leaf spring at a location between its ends. The leaf spring is positioned so that one end engages the abutment on the valve body, and the opposite end of the spring bears against the outer peripheral surface of the tube and urges the tube in an outward direction.

The operative parts of the sprinkler head are covered by a decorative plate which is positioned against the ceiling and the plate is carried by a cup-shaped sleeve made of heat insulating material that is mounted on the outer surface of the valve body by a sliding friction connection. The sleeve includes a series of feet that are covered with metal shoes and the shoes are connected to the decorative plate by a low melting point, fusible material.

When the sprinkler head is exposed to an elevated temperature, the fusible material associated with the decorative plate will melt, thereby releasing the decorative plate. Subsequently, the fusible element associated with the lever assembly will melt, and the force of the leaf spring will wedge the balls inwardly of the tube, thereby releasing the lever assembly and opening the valve cap.

With the sprinkler head of the invention, none of the operative parts of the sprinkler head are exposed to view and the only exposed portion is the decorative plate.

The sprinkler head has an improved rate of heat transfer to the fusible element associated with the latch assembly, as compared to concealed sprinkler heads as used in the past. This is due to the fact that the fusible element associated with the lever assembly is located, at least in part, beneath the lower surface of the ceiling and will be in direct heat transfer relation to the heated air and gases in the building. This provides a faster response rate than concealed type sprinkler heads, as employed in the past.

The use of the cup-shaped sleeve that supports the decorative plate provides an improved degree of adjustment for installation of the sprinkler head. After the valve body has been connected to the water line, the sleeve carrying the decorative plate is merely slipped upwardly on the valve body until the decorative plate engages the ceiling. This construction insures that the decorative plate will be flush against the ceiling regardless of any vertical variations in position between the valve body and the ceiling. The cup-shaped sleeve is also capable of being tilted slightly with respect to the valve body, thereby enabling the decorative plate to be positioned against the ceiling even if the ceiling is not precisely perpendicular to the axis of the valve body.

The use of the cup-shaped sleeve also facilitates the installation of the decorative plate, for the sleeve is merely slid upwardly around the valve body and held by the friction fit and is not necessary to connect any fastening elements between the valve body and the decorative plate, as required with prior types of concealed sprinkler heads.

Other objects and advantages will appear in the course of the following description.

DESCRIPTION OF THE DRAWINGS

The drawings illustrate the best mode presently contemplated of carrying out the invention.

In the drawings:

FIG. 1 is a vertical section showing the sprinkler head of the invention as mounted above the ceiling of a building;

FIG. 2 is a view similar to FIG. 1 showing the decorative plate in the released position;

FIG. 4 is a section taken along line 4—4 of FIG. 1 with parts broken away;

DESCRIPTION OF THE ILLUSTRATED EMBODIMENT

Figure 3:
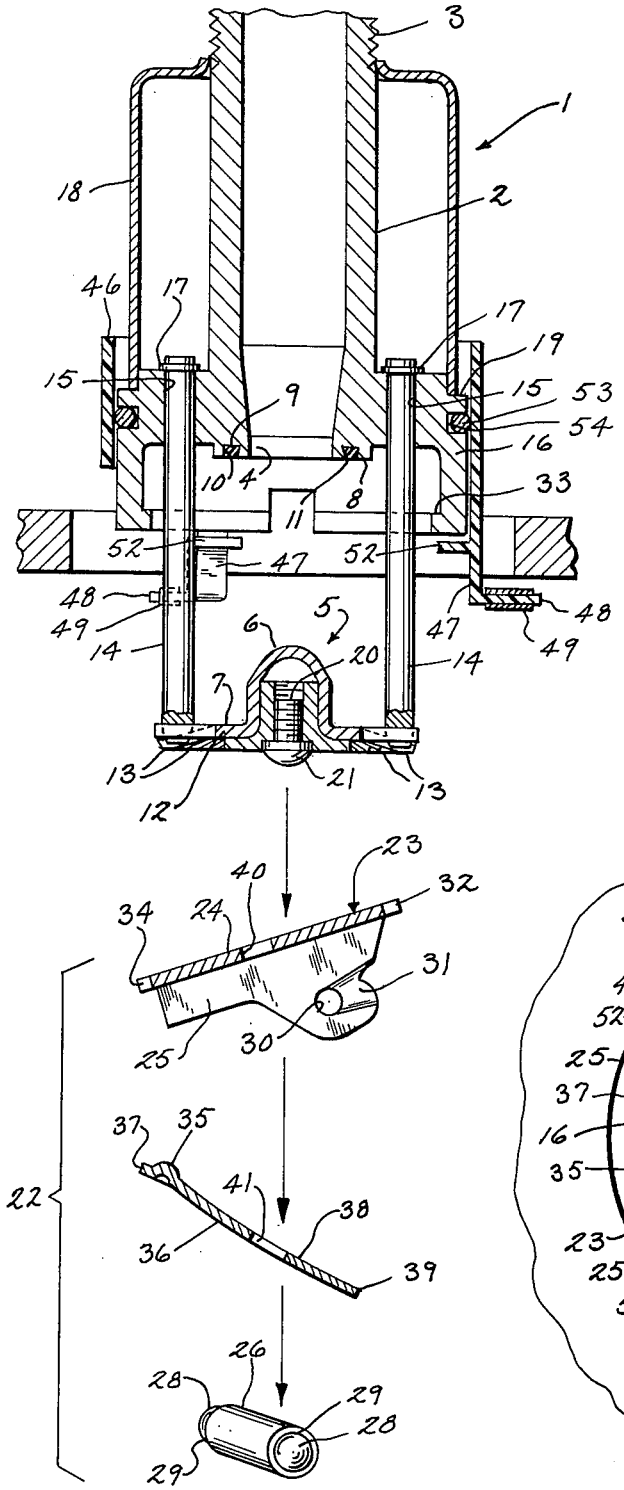
FIG. 3 is a view similar to FIG. 1 showing the valve cap and lever assembly in the released position.
Figure 6:
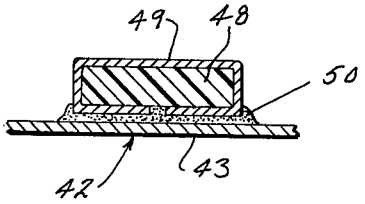
FIG. 6 is a view taken along line 6—6 of FIG. 1 and showing the attachment of the feet of the cup-shaped sleeve to the decorative plate.

The drawings illustrate a concealed type automatic sprinkler head 1 which is composed of an orifice body 2 having a threaded upper end 3 that is adapted to be connected to a vertical water line. The lower end of the orifice body defines an outlet 4 which is normally closed by a valve cap assembly 5.

As shown in FIGS. 1-3, the valve cap assembly 5 includes a generally conical shaped valve member 6 which is bordered by an annular surface 7 which engages the lower end 8 of the valve body. To seal the surface 7 with respect to end surface 8, an O-ring 9 is located within a groove 10 formed in the end surface. As best shown in FIG. 3, one edge 11 of the groove 10 is undercut which serves to retain the O-ring within the groove on release of the lever mechanism, as illustrated in FIG. 3. This prevents the O-ring from falling downwardly with the valve member 6 and eliminates the possibility of the O-ring encircling the valve member.

A deflector plate 12 is formed integrally with the valve 6 and the deflector plate includes a series of radially extending tines 13, as best illustrated in FIG. 4.

Rods 14 are connected to two of the tines at diametrically opposite locations on the deflector plate, and the rods 14 extend upwardly through openings 15 in the valve body. The upper ends of the rods 14 are provided with enlarged heads 17 which limit the downward movement of the rods with respect to the valve body on release of the valve 6, and thereby position the deflector plate in the proper location to establish the desired water spray pattern.

The rods are enclosed by a cup-shaped housing 18 and the lower end of the housing is engaged with a shoulder 19 on the valve body 16.

As shown in FIG. 1, a compression screw 20 is threaded within a central bore in the valve 6 and the head 21 of the screw projects downwardly and engages a lever assembly 22 which serves to retain the valve 6 in the closed position.

Figure 5:
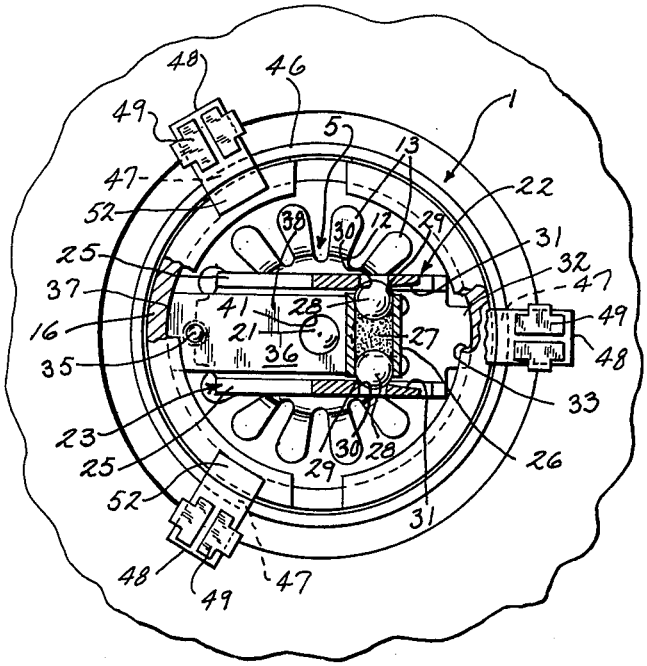
FIG. 5 is a view taken along line 5—5 of FIG. 2 with parts broken away.

In accordance with the invention, the lever assembly 22 includes a lever 23 having a central section 24 and a pair of spaced parallel arms 25 which extend outwardly from the central section 24. Extending between the arms 25, as best shown in FIG. 5, is a cylindrical tube 26 and a metallic fusible element 27, which is designed to melt at a temperature generally in the range of about 135° F to 212° F, is located within the central portion of the tube. Balls 28 are impressed into the outer ends 29 of the fusible element 27. Each ball projects outwardly of the respective end of the tube 26 and is seated within an annular socket 30 formed in the respective arm 25. Connecting each socket 30 with the edge of the arm 25 is an inclined ramp 31. The balls 28, pre-assembled as a unit with the tube 26 and fusible element 27, are moved up the respective ramps and snapped into the sockets.

As illustrated in FIG. 5, one end 32 of the lever 23 is engaged with the annular ledge or abutment 33 formed on the vale body. The opposite end of the lever is formed with a central notch 34 which is engaged with an upwardly extending dimple 35 on a leaf spring or second lever member 36. One end 37 of the leaf spring 36 is engaged with the ledge 33, while the central section 38 of the spring is spaced beneath lever 23 and the opposite end 39 is disposed in engagement with the peripheral surface of the tube 26. As shown in FIG. 1, the lever 23 and spring 36 are provided with aligned central openings 40 and 41 within which a tool can be inserted to adjust the position of the compression screw 20. After the lever 23 and spring 36 have been assembled, the compression screw 20 is turned out, thereby pivoting the lever 23 about its fulcrum on the ledge or abutment 33, and due to the fact that the spring 37 is fulcrummed about the end of the lever, the spring will bow or deflect to increase the spring force against the tube 26.

The operative parts of the sprinkler head are covered by a decorative plate 42 having a generally flat body 43, and a series of tabs 44 extend upwardly from the body and abut the ceiling 45, as shown in FIG. 1.

In accordance with a feature of the invention, the decorative plate 42 is carried by a ring or sleeve 46 that is connected by a friction fit to the outer surface of the ring 16 of valve body 2. The sleeve 46 has a plurality of downwardly extending legs 47 which terminate in outwardly extending feet 48. Sleeve 46 is made of a thermosetting resin or other heat insulating material which will not melt or decompose at temperatures up to about 250° F. In order to provide a proper surface for connection of the feet 48 to the metallic decorative plate, metal shoes 49 formed of copper, or the like are secured to feet 48 and a layer of fusible material 50 connects each shoe 49 and the upper surface of the plate. The fusible material 50 is a low melting point alloy, adapted to melt at an elevated temperature of about 135° F to 180° F, and on melting, will enable the decorative plate to be released. To aid in the release of the decorative plate 42, a coil spring 51 is disposed between flanges 52, which extend inwardly from legs 47, and the plate. On melting of the fusible material 50, the force of the spring 51 will urge the decorative plate 42 downwardly, as shown in FIG. 2. As the sleeve 46 is formed of heat insulating material, heat transfer from plate 42 to the valve body 2 will be eliminated, thereby increasing the rate of response of the sprinkler head.

The sleeve 46 is slidable on the valve body, and is connected to the ring by means of a friction connection provided by spring 53 which is disposed in a circumferential groove 54 in the ring. The force of the spring 53 acts outwardly against the sleeve 46, thereby retaining the sleeve in any desired position with respect to the valve body.

Sleeve 46, along with the attached connective decorative plate 42, is installed by merely slipping the sleeve around the ring 16 and pushing the unit upwardly until the decorative plate engages the lower surface of the ceiling 45. The frictional resistance of spring 53 will hold the sleeve 46 and the decorative plate in position. This sliding construction insures that the decorative plate 42 will be flush against the ceiling regardless of any variations in position between the valve body and the ceiling. As the sleeve 46 is able to tilt or swivel slightly with respect to valve body 2, the attached plate 42 follow or adjust to irregularities between the plane of the ceiling and the axis of the valve body.

The construction also facilitates the installation of the decorative plate 42, for the sleeve 46 is merely slid upwardly around the ring 16 of the valve body 2 and held by the friction fit, and it is not necessary to connect any auxiliary fastening members between the valve body and the decorative plate in order to maintain the plate in position. This construction also facilitates the removal and replacement of the decorative plate for ceiling painting.

In operation, when the sprinkler head is subjected to an elevated temperature, the layers of fusible material 50 will melt and the force of the spring 51 will thereby release the decorative plate, as shown in FIG. 2. The tabs 44 serve to space the body 43 of plate 42 beneath the ceiling so that the heated gases can flow across the upper surface of body 43 and increase the rate of heat transfer to the fusible material 50.

As the fusible element 27 associated with the lever assembly is at least in part located below the lower surface of the ceiling, it is in a position where heat will be readily transferred to the fusible element. When the element 27 melts, the force of the spring 36 will wedge the balls 29 inwardly of the tube 26 to a position where the tube will be forced downwardly from between the arms 25, to thereby release the lever assembly 22 and open the valve cap assembly 5. The valve 6 and the attached deflector plate will move downwardly, as shown in FIG. 3, to a position beneath the ceiling and the water being discharged from the outlet 4 will be deflected outwardly in the desired spray pattern by the deflector plate 12.

As the fusible element 27 associated with the lever assembly 22 is located, at least in part, below the lower surface of the ceiling, a fastener response is achieved than in prior art sprinkler heads in which the fusible material was located a substantial distance above the lower surface of the ceiling.

Various modes of carrying out the invention are contemplated as being within the scope of the following claims particularly pointing out and distinctly claiming the subject matter which is regarded as the invention.

We claim:

1. A sprinkler head, comprising a body having an inlet to be connected to a water line and having an outlet, internal abutment means disposed in the body and located downstream of the outlet, valve means to close the outlet, a lever assembly engaged with the valve means and disposed to hold the valve means in a closed position, said lever assembly including a first lever member engaged with said valve means and having one end engaged with said abutment means, temperature responsive release means carried by said first lever member and including a fusible element adapted to melt at an elevated temperature, and a second lever member having one end engaged with said abutment means and having the opposite end portion engaged with said release means, the opposite end of said first lever member being engaged with said second lever member at a location between the ends of said second lever member, manually adjustable means engaged with said first lever member for exerting a force through said second lever member on said release means in a direction to urge said release means out of engagement with said first lever member, melting of said fusible element enabling said second lever member to release the release means from engagement with said first lever member and thereby open said valve means.

2. The sprinkler head of claim 1, wherein the fusible element at least in part is located beneath the lower extremity of the body.

3. The sprinkler head of claim 1, wherein said adjustable means includes a compression screw threadedly engaged with the valve means and extending downwardly from said valve means and engaged with said first lever member, threading of said screw in a downward direction acting to pivot said first named end of the first lever member downward about said abutment means to deform said second lever member downwardly and increase the force against said release means.

4. The sprinkler head of claim 1, and including deflector means connected to said valve means, and means for retaining the valve means and deflector means in a predetermined spaced position beneath the outlet on release of the lever assembly, whereby the water being discharged from the outlet will strike the deflector means and be deflected in the desired spray pattern.

5. The sprinkler head of claim 1, wherein said abutment means comprises an annular ledge on said body.

6. The sprinkler head of claim 5, wherein said lever members are engaged with said annular ledge at diametrically opposite locations on the body.

7. The sprinkler head of claim 1, wherein said first lever member includes a pair of spaced arms that extend downwardly, and said release means includes a tube extending between said arms and containing said fusible element, said release means also including a movable member located in each end of the tube and located on opposite sides of said fusible element, said movable members being engaged with the respective arms.

8. The sprinkler head of claim 7, wherein said movable members are balls and said arms are provided with sockets to receive the balls.

9. A sprinkler head, comprising a body having an inlet to be connected to a water line and having an outlet, internal abutment means disposed in the body and located downstream of the outlet, valve means to enclose the outlet, a lever assembly engaged with the valve means and disposed to hold the valve means in a closed position, said lever assembly including a lever engaged with said valve means and having one end pivoted on said abutment means, said lever having a pair of spaced downwardly extending arms, a tube disposed between the arms, a low melting point fusible element disposed within the tube, a movable member disposed within an end of the tube and engaged with said fusible element, the outer portion of said movable member projecting outwardly of the tube and engaged with the respective arm, a spring member having one end pivoted on said abutment means and having a portion engaged with the peripheral surface of the tube, said spring exerting a force on said tube in a downward direction with said force being resisted by engagement of said movable member with said arm, the opposite end of said lever being engaged with said spring at a location spaced from the pivoted end of the spring, and means for pivoting said lever downwardly, downward pivotal movement of said lever acting to deform said spring downwardly and increase the force against the tube.

10. The sprinkler head of claim 9, wherein said means for pivoting the lever comprises a compression screw threadedly engaged with said valve means and having a head engaged with said lever, whereby unthreading of said screw will pivot the lever.

11. The sprinkler head of claim 10, wherein the lever and spring are provided with openings aligned with said screw, whereby a tool can be inserted through said openings to engage the screw.

12. A concealed sprinkler head to be mounted above the ceiling of a building, comprising a valve body having an inlet adapted to be connected to a water line and having an outlet, valve means to enclose the outlet, a lever assembly engaged with the valve means for holding said valve means in a closed position and including a fusible element, a cover plate adapted to engage the lower surface of the ceiling, a slidable member mounted for sliding movement with respect to a surface, said surface being fixed in relation to the valve body, frictional connection means disposed between said slidable member and said surface for providing frictional resistance to sliding movement between said slidable member and said surface to thereby hold said slidable member at any desired position with respect to said surface, and connecting means connecting the slidable member and cover plate, said connecting means including a fusible material, melting of said fusible material when said sprinkler head is exposed to an elevated temperature causing said cover plate to be released from engagement with said slidable member and subsequent melting of said fusible element causing said lever assembly to be released to thereby open said valve means, said slidable member being slid upwardly with respect to said body to bring said cover plate into bearing engagement with the ceiling and being held against said ceiling by the frictional connection means.

13. The sprinkler head of claim 12, wherein said slidable member is a sleeve formed of heat insulating material.

14. The sprinkler head of claim 12, wherein said frictional connection means comprises a groove formed in the outer surface of the valve body, and a spring disposed within the groove and adapted to engage said slidable member.

15. The sprinkler head of claim 12, wherein said slidable member includes a generally cylindrical sleeve and a plurality of laterally extending feet connected to said sleeve, said connecting means serving to connect said feet to said cover plate.

16. The sprinkler head of claim 15, wherein said slidable member is formed of a non-metallic heat insulating material, and the lower surface of each foot is provided with a heat conductive coating disposed between the foot and the fusible material.

17. The sprinkler head of claim 12, and including biasing means disposed between the body and the cover plate for urging the plate downwardly on melting of said fusible material.

18. The sprinkler head of claim 17, wherein the biasing means is a spring.

19. A concealed sprinkler head to be mounted above the ceiling of a building, comprising a body having an inlet adapted to be connected to a water line and having an outlet, valve means to enclose the outlet, a lever assembly engaged with the valve means for holding said valve means in a closed position and including a fusible element, a cover plate adapted to engage the lower surface of the ceiling, a slidable member mounted for free sliding movement on the valve body, and fusible means connecting the slidable member and the cover plate, melting of said fusible means when said sprinkler head is exposed to an elevated temperature causing said cover plate to be released from engagement with said slidable member and subsequent melting of said fusible element causing said lever assembly to be released to thereby open said valve means, said slidable member including heat insulating means for preventing direct heat conduction from said cover plate to said valve body, said slidable member being slid upwardly with respect to said body to bring said cover plate into bearing engagement with the ceiling.

20. The sprinkler head of claim 19, wherein said cover plate includes a relatively flat body portion and a plurality of spaced upstanding tabs adapted to engage the ceiling and space said body portion below the ceiling.

21. A concealed sprinkler head to be mounted above the ceiling of a building, comprising a body having an inlet adapted to be connected to a water line and having an outlet, valve means to enclose the outlet, a lever assembly engaged with the valve means for holding said valve means in a closed position and including a fusible element, a cover plate adapted to engage the lower surface of the ceiling, a slidable member mounted for free sliding movement on the valve body, fusible means connecting the slidable member and the cover plate, and biasing means operably engaged with the upper surface of the cover plate for exerting a downward force on the cover plate to thereby aid in releasing the cover plate on melting of the fusible means.

22. The sprinkler head of claim 21, wherein the biasing means comprises a spring disposed between the cover plate and the slidable member.

23. A concealed sprinkler head to be mounted above the ceiling of a building, comprising a body having an inlet adapted to be connected to the water line and having an outlet, valve means to enclose the outlet, a lever assembly engaged with the valve means for holding said valve means in a closed position and including a fusible element, a cover plate adapted to engage the lower surface of the ceiling, a generally cylindrical member mounted for sliding movement with respect to a surface of said body, said cylindrical member being spaced radially of said surface to provide an annular clearance therebetween, frictional means disposed within said annular clearance for providing a frictional connection between the cylindrical member and said body, connecting means interconnecting said cylindrical member and said cover plate, said connecting means including a fusible material, melting of said fusible material when said sprinkler head is exposed to an elevated temperature causing said cover plate to be released from engagement with said cylindrical member and subsequent melting of said fusible element causing said lever assembly to be released to thereby open said valve means, the radial spacing between said cylindrical member and said surface providing limited tilting movement of said cylindrical member and said cover plate with respect to said body to thereby enable said cover plate to be positioned against said ceiling if the ceiling is not perpendicular to the axis of said body.

24. The sprinkler head of claim 23, wherein said cylindrical member is formed of heat insulating material.

25. The sprinkler head of claim 24, wherein said cylindrical member is provided with a plurality of generally horizontal feet, said fusible material interconnecting said feet and the upper surface of said cover plate.

* * * * *

UNITED STATES PATENT AND TRADEMARK OFFICE

CERTIFICATE OF CORRECTION

PATENT NO. : 4,105,076

DATED : August 8, 1978.

INVENTOR(S) : JOHN R. SIMONS ET AL

It is certified that error appears in the above-identified patent and that said Letters Patent are hereby corrected as shown below:

In the Abstract, Line 23, Cancel "asembly" and substitute therefor ---assembly---, Column 4, Line 11, Cancel "vale" and substitute therefor ---valve---, Column 5, Line 8, Before "follow" insert ---can---, Column 5, line 36, After "plate" insert ---12---, Column 7, Line 28, CLAIM 12, After "and" insert ---the---.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*